US007172545B2

(12) United States Patent
Howell et al.

(10) Patent No.: US 7,172,545 B2
(45) Date of Patent: Feb. 6, 2007

(54) REGISTRATION OF INTERMITTENTLY MOVED FASTENER TAPE WITH CONTINUOUSLY MOVING WEB

(75) Inventors: Clifton Ronald Howell, Buford, GA (US); David C. Wallace, Lilburn, GA (US)

(73) Assignee: Illinois Tool Works Inc., Glenview, IL (US)

( * ) Notice: Subject to any disclaimer, the term of this patent is extended or adjusted under 35 U.S.C. 154(b) by 78 days.

(21) Appl. No.: 11/081,368

(22) Filed: Mar. 16, 2005

(65) Prior Publication Data

US 2006/0211559 A1 Sep. 21, 2006

(51) Int. Cl.
*B31B 1/90* (2006.01)
*B65B 61/18* (2006.01)

(52) U.S. Cl. ..... 493/213; 493/379; 493/381; 493/927; 53/412

(58) Field of Classification Search ..... 493/10, 493/11, 17, 212, 214, 379, 381, 393, 394, 493/464, 927; 53/412, 133.1, 139.2; 29/766, 29/768
See application file for complete search history.

(56) References Cited

U.S. PATENT DOCUMENTS 6,327,754 B1 * 12/2001 Belmont et al. ..... 383/63
6,770,018 B2 * 8/2004 Tomic ..... 493/927
6,780,146 B2 * 8/2004 Thomas et al. ..... 53/412
6,842,973 B2 * 1/2005 Share et al. ..... 29/768
6,843,038 B1 * 1/2005 Haws ..... 53/139.2
6,973,704 B2 * 12/2005 Cortigiano, Sr. ..... 29/768
2002/0152720 A1 * 10/2002 Kinigakis et al. ..... 53/412
2003/0162643 A1 * 8/2003 Tomic ..... 493/394
2003/0183314 A1 * 10/2003 Share et al. ..... 29/768

* cited by examiner

*Primary Examiner*—Loius Huynh
(74) *Attorney, Agent, or Firm*—Ostrager, Chong Flaherty & Broitman P.C.

(57) ABSTRACT

A method of manufacture comprising the following steps: (a) continuously advancing a web of bag making material at a first rate; (b) continuously joining portions of a downstream portion of a fastener tape to respective portions of the continuously advancing web of bag making material; (c) intermittently advancing an upstream portion of the fastener tape while the downstream portion is advancing continuously, the halt at the end of each intermittent advance being the start of the next work cycle, the upstream portion of the fastener tape being stationary during a respective dwell time of each work cycle and advancing during the remainder of each work cycle at a second rate faster than the first rate; (d) accumulating a portion of the fastener tape disposed between the upstream and downstream portions to compensate for the difference in the first and second rates during the aforementioned remainder of each work cycle; and (e) inserting a respective slider onto the upstream portion of the fastener tape during each dwell time.

16 Claims, 6 Drawing Sheets

REGISTRATION OF INTERMITTENTLY MOVED FASTENER TAPE WITH CONTINUOUSLY MOVING WEB

BACKGROUND OF THE INVENTION

The present invention generally relates to methods and apparatus for registering a plastic fastener tape relative to a web of bag making material in a packaging or bag making machine.

During the automated manufacture of reclosable bags, a continuous length of thermoplastic fastener tape unwound from a supply reel or spool is joined (e.g., by conductive heat sealing) to a continuous web of bag making material (e.g., a monolayer of thermoplastic film or a laminate comprising a first layer of thermoplastic film and a second layer or metal, paper or thermoplastic material). The web-to-fastener tape sealing operation can be performed either intermittently or continuously.

Often the fastener tape has sliders inserted thereon, one slider per section, before that section is joined to the bag making material. In the latter event, it is also customary to form one slider end stop structure per section of the fastener tape prior to the tap being joined to the bag making material. When the fastener tape carries a repeating structural feature (e.g., a slider or slider end stop structure), it is important that that those structural features be accurately placed at regular intervals to ensure their proper registration with respective pockets or receptacles of the packages or bags being manufactured. In particular, each slider end stop structure must be correctly aligned with a corresponding cross seal formed on the package or bag, which cross seal is later divided to become respective side seams of adjacent packages or bags.

Many existing bag making machines produce reclosable bags by a process wherein a continuously advancing folded web of bag making material is incrementally joined to a continuously advancing fastener tape. In subsequent steps, the continuously advancing web/fastener tape assembly is cross sealed to form pockets, the pockets are filled with product and closed, and then the filled pockets are severed from the remainder of the work in process to form completed bags. A drag sealer is a known apparatus for joining a continuously advancing fastener tape to a continuously advancing web of bag making film.

There is a need for a method and an apparatus for inserting sliders and/or forming slider end stop structures on intermittently moved fastener tape at a location upstream of a machine station that joins continuously advancing fastener tape to continuously advancing bag making material.

BRIEF DESCRIPTION OF THE INVENTION

The present invention is directed to methods and apparatus for inserting sliders and/or forming slider end stop structures on intermittently moved fastener tape at a location upstream of a machine station (e.g., a drag sealer) that joins continuously advancing fastener tape to continuously advancing bag making material.

One aspect of the invention is a method of manufacture comprising the following steps: (a) continuously advancing a web of bag making material at a first rate; (b) continuously joining portions of a downstream portion of a fastener tape to respective portions of the continuously advancing web of bag making material; (c) intermittently advancing an upstream portion of the fastener tape while the downstream portion is advancing continuously, the halt at the end of each intermittent advance being the start of the next work cycle, the upstream portion of the fastener tape being stationary during a respective dwell time of each work cycle and advancing during the remainder of each work cycle at a second rate faster than the first rate; (d) accumulating a portion of the fastener tape disposed between the upstream and downstream portions to compensate for the difference in the first and second rates during the remainder of each work cycle; and (e) inserting a respective slider onto the upstream portion of the fastener tape during each dwell time.

Another aspect of the invention is a method of manufacture comprising the following steps: (a) continuously advancing a web of bag making material at a first rate; (b) continuously joining portions of a downstream portion of a fastener tape to respective portions of the continuously advancing web of bag making material; (c) intermittently advancing an upstream portion of the fastener tape while the downstream portion is advancing continuously, the halt at the end of each intermittent advance being the start of the next work cycle, the upstream portion of the fastener tape being stationary during a respective dwell time of each work cycle and advancing during the remainder of each work cycle at a second rate faster than the first rate; (d) accumulating a portion of the fastener tape disposed between the upstream and downstream portions to compensate for the difference in the first and second rates during the remainder of each work cycle; and (e) deforming a respective section of the upstream portion of the fastener tape during each dwell time, each section having a width substantially less than the length of each intermittent advance.

A further aspect of the invention is a method of manufacture comprising the following steps: (a) continuously advancing a web of bag making material along a first process pathway that passes through a joining station; (b) advancing a fastener tape comprising mutually interlocked first and second fastener strips made of flexible material along a second process pathway that passes through the joining station, the second process pathway comprising a first portion disposed upstream of and a second portion disposed at and downstream from the joining station, the portion of the fastener tape resident in the first portion of the first process pathway being advanced intermittently and the portion of the fastener tape resident in the second portion of the first process pathway being advanced continuously; (c) continuously joining together the respective portions of the fastener tape and the web of bag making material continuously advancing through the joining station; and (d) during successive dwell times between successive intermittent advances, inserting respective sliders onto the fastener tape, the sliders being inserted at a fixed location along the first portion of the first process pathway, the result being a succession of sliders spaced at intervals along the length of the portion of the fastener tape disposed downstream of the fixed location.

Yet another aspect of the invention is a system comprising a packaging machine, a fastener processing machine, a fastener tape comprising mutually interlocked first and second fastener strips made of flexible material that follow a first process pathway through the fastener processing machine and then through the packaging machine, and a controller for controlling the operation of the packaging machine and the fastener processing machine, wherein: the fastener processing machine comprises a supply reel having a portion of the fastener tape wound thereon with a paid-out portion of the fastener tape connected thereto, a slider insertion device that is activatable for inserting a slider on a section of the paid-out portion of the fastener tape that is resident in a slider insertion zone, a clamp disposed downstream of the slider insertion device, the clamp being activatable for clamping a section of the paid-out portion of the fastener tape that is resident in a clamping zone, an accumulator disposed downstream of the clamp for accumulating fastener tape, and means for pulling the section that is resident in the slider insertion zone toward the packaging machine; the packaging machine comprises a supply roll having portions of a web of bag making material wound thereon with a paid-out portion of the web connected thereto, means for advancing the paid-out portion of the web, and a station for joining respective sections of the paid-out portions of the fastener tape and the web to each other while the paid-out portion of the web is advancing; and the controller is programmed to control the operation of the slider insertion device, the clamp, the fastener tape pulling means and the web advancing means so that the following events occur during each work cycle: (a) during the entire work cycle, the web advancing means advances the web of bag making material; (b) during a dwell time of the work cycle, the clamp clamps the section of the paid-out portion of the fastener tape that is resident in the clamping zone; (c) during the dwell time, the slider insertion device inserts a slider onto the section of the paid-out portion of the fastener tape that is resident in the slider insertion zone; and (d) during the remainder (non-dwell time) of the work cycle, the pulling means advances the section of the paid-out portion of the fastener tape that is resident in the slider insertion zone.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

In accordance with various embodiments of the present invention to be disclosed hereinafter, a fastener tape processing machine, in which an upstream portion of a fastener tape is advanced intermittently, is combined with a bag making machine, in which a downstream portion of the same fastener tape is advanced continuously. During each dwell time, a respective slider end stop structure is formed on the upstream portion of the fastener tape at a first fixed station and a respective slider is inserted on the upstream portion of the fastener tape at a second fixed station that is upstream or downstream relative to the first fixed station. The fastener tape portion resident in the fastener tape processing machine is advanced intermittently, eventually passing through an accumulator. The portion of processed fastener tape exiting the accumulator is then passed through an apparatus, such as a drag sealer, that joins incremental portions of the fastener tape to a continuously advancing web of bag making material. Thereafter the web with attached fastener tape is advanced continuously, being thereby pulled through the drag sealer, by conventional devices, such as pinch rollers, in the bag making machine.

Figure 1:
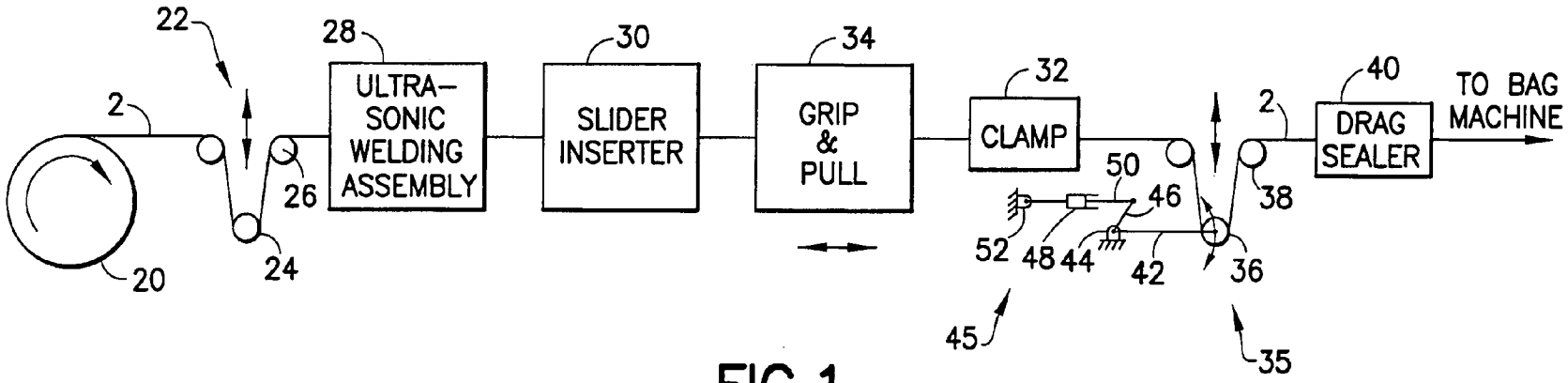
FIG. 1 is a block diagram representing automated equipment for inserting sliders and forming slider end stop structures on a fastener tape, stretching the fastener tape, and then joining the stretched fastener tape to bag making material in accordance with one embodiment of the invention.

A method of registering intermittently moved fastener tape with continuously moving bag making material in accordance with one embodiment of the invention is shown in FIG. 1. A length of thermoplastic fastener tape 2, comprising, e.g., respective lengths of a pair of interlocked flanged zipper strips (e.g., of the slider-actuated type disclosed in U.S. Pat. No. 6,047,450), is unwound from a powered supply reel 20 and passed through an unwind dancer assembly 22 comprising a weighted dancer roller 24 that is supported on a shaft, which shaft is freely vertically displaceable (as indicated by the double-headed arrow in FIG. 1) along a slotted support column (not shown). The weight of the dancer roller 24 takes up any slack in the portion of fastener tape suspended between the supply reel 20 and a guide roll 26. A sensor may be provided for detecting the vertical position of the dancer roller 24. The feedback signal from that sensor is used by a programmed logic controller (PLC; not shown in FIG. 1) to control the motor that powers the supply reel 20, thereby controlling the payout of fastener tape 2.

An ultrasonic welding assembly 28 is disposed downstream of the guide roll 26. During each dwell time, the plastic zipper strips are softened and/or melted and shaped by the ultrasonic welding assembly in a respective zone. The ultrasonically welded plastic material of the respective zipper strips is shaped to form a respective slider end stop structure in each zone upon cooling. The deformed portions of the zipper strips are also fused together in each zone. Each slider end stop structure will form back-to-back slider end stops when the end stop structure is cut during bag formation. The ultrasonic welding assembly 28 may comprise an ultrasonic transducer acoustically coupled to a horn, the horn being opposed by an anvil (not shown in FIG. 1). Either the horn or the anvil or both reciprocate between retracted and extended positions. The ultrasonic transducer is activated and the horn and/or anvil is extended in response to activation signals from the aforementioned PLC. While a portion of the fastener tape is being pressed between the horn and anvil, the horn emits ultrasonic wave energy at an intensity and frequency designed to soften and/or melt the thermoplastic fastener tape during each dwell time. The horn and/or anvil may be provided with recesses designed to form the softened and/or molten thermoplastic material into a slider end stop structure. When the softened/melted material cools, the material of the respective zipper strips fuses together to form a zipper joint.

The ultrasonically welded and shaped portion of fastener tape is then advanced to the next station, comprising a conventional slider insertion device 30 that inserts a respective slider onto each bag-width section of fastener tape during each dwell time. Each slider is inserted adjacent a respective slider end stop structure on the continuous fastener tape. The slider insertion device comprises a reciprocating pusher that is alternately extended and retracted by an air cylinder (not shown in FIG. 1). As the pusher extends, it pushes the slider onto the fastener tape. The other parts of such a slider insertion device, including a track along which sliders are fed, are well known and will not be described in detail herein.

During each dwell time, the fastener tape is gripped by a clamp 32, so that the unwound length of fastener tape spanning the distance between guide roller 26 and clamp 32 is stationary during ultrasonic welding and slider insertion. The clamp 32 may comprise a clamping gripper assembly of the type disclosed in U.S. patent application Ser. No. 11/081,369 filed Mar. 16, 2005 and entitled "Apparatus for Repeatedly Advancing Fastener Tape a Predetermined Distance". This clamping gripper assembly comprises a pair of oppositely moving gripper arms (not shown). When the clamping gripper assembly is in a closed state, respective gripper pads on the gripper arms grip a first section of the length of straight zipper material. The gripper arms are actuated by a double-acting parallel motion air cylinder (not shown in FIG. 1), which is controlled by the aforementioned PLC. The clamping gripper assembly may comprise a carriage that is slidable along a straight rail to allow adjustment of its longitudinal position. But once the adjustment has been made, the clamping gripper assembly is secured relative to the rail, e.g., by means of a thumbscrew, so that the clamping gripper assembly is stationary during machine operation.

At the end of each dwell time, the fastener tape is gripped by a grip-and-pull mechanism 34 and then released by the clamp 32. Also, the ultrasonic horn or anvil or both are retracted and the pusher of the slider inserter is retracted, so that the length of fastener tape is free to advance except where the fastener tape is being gripped by the grip-and-pull mechanism 34. Then the grip-and-pull mechanism 34 is operated to pull the unwound length of fastener tape (ultrasonically stomped and carrying sliders) forward one bag width. The most recently inserted slider leaves the slider insertion zone and the most recently formed slider end stop structure is moved from the ultrasonic welding station to the slider insertion zone. The clamp 32 is then closed again, following which the grip-and-pull mechanism 34 is opened and returned to its home position. The grip-and-pull mechanism 34 may comprise an indexing gripper assembly that is linearly displaced by an indexing drive mechanism as disclosed in the aforementioned U.S. patent application Ser. No. 11/081,369 filed concurrently herewith. The indexing gripper assembly comprises a carriage that rides on a straight rail. The indexing drive mechanism comprises a lead screw driven to rotate by a servomotor. The indexing gripper assembly further comprises a nut threadably coupled to the lead screw and rigidly coupled to the carriage. The nut converts the rotation of the lead screw into linear displacement of the carriage. The indexing gripper assembly further comprises a pair of oppositely moving gripper arms. When the indexing gripper assembly is in a closed state, respective gripper pads on its gripper arms grip a second section (disposed upstream of the clamped first section) of the length of fastener tape. The gripper arms of the indexing gripper assembly are actuated by a double-acting parallel motion air cylinder, which is again controlled by the aforementioned PLC.

In accordance with one embodiment of the invention, during each work cycle the grip-and-pull mechanism 34 advances the gripped portion of the fastener tape by a distance that is slightly less (e.g., in one implementation, less by about 0.7%) than the distance that a paid-out portion of the web of bag making film is advanced during the same work cycle. This difference in length will be compensated for by stretching the fastener tape upstream of a drag sealer 40 in the manner described below.

Downstream from the clamp 32, the fastener tape 2 passes through a tape accumulating dancer assembly (hereinafter "accumulator") 35, around a guide roller 38 and then through the drag sealer 40. The portion of the fastener tape that is downstream from the guide roller 38 is pulled through the drag sealer 40 at a constant speed by conventional means, such as opposing sets of pinch rollers (not shown in FIG. 1). The drag sealer (described in detail below) joins incremental portions of the fastener tape to a paid-out portion of a web of bag making material that is being continuously advanced through a bag machine. Many different types of bag making material can be used to make the bags. Entirely thermoplastic bag making material may take the form of either a monolayer or a laminate or coextrusion comprising a gas barrier layer and/or a low-melting-point sealant layer. Alternatively, the bag making material may comprise a laminate wherein one of the layers is not made of thermoplastic material, e.g., a metallized thermoplastic film or a sheet of paper coated with a layer of thermoplastic material.

Still referring to FIG. 1, the accumulator 35 comprises a weighted dancer roller 36 that is supported on a shaft, which shaft is freely vertically displaceable (as indicated by the double-headed arrow in FIG. 1) along a slotted support column (not shown) during a major portion of each work cycle. The weight of the dancer roller 36 takes up any slack in the portion of fastener tape suspended between the clamp 32 and the drag sealer 40. The shaft that supports the dancer roller 36 is in turn fixed to a distal end of an arm 42 that is pivotably coupled to a fixed support 44. A second arm 46 is rigidly connected to arm 42 at the pivot point, so that pivoting of arm 46 causes arm 44 to pivot to the same degree. The processing line depicted in FIG. 1 further comprises a extension mechanism 45 that operates during a minor portion of each work cycle, the minor and major portions of each successive work cycle occurring in alternating sequence. In the specific implementation depicted in FIG. 1, the extension mechanism 45 comprises an air cylinder 48 having a piston rod 50. The air cylinder is pivotably coupled to a fixed support 52, while a distal end of the piston rod 50 is pivotably coupled to a distal end of the arm 46. At the appropriate time during each work cycle, the PLC activates the air cylinder so that the piston rod 50 is suddenly extended, which in turn causes the arms 42 and 46 to pivot (clockwise in the view seen in FIG. 1). This action forces the dancer roller 36 to an extended position for an instant while the fastener tape 2 is being held by clamp 32. This stretches the fastener tape for an instant to make up for the difference between the distance that the bag making film is advanced during each work cycle by the bag machine and the distance that the fastener tape is advanced during each work cycle by the grip-and-pull mechanism 34. The stretched portion of the fastener tape 2 is incrementally joined to the continuously advancing bag web by the drag sealer 40, thereby locking the instant of higher fastener tape tension onto the bag web. While the tape/web assembly downstream of the drag sealer continues to advance at a constant speed, the bag machine (not shown in the drawings) cross seals the tape/web assembly to form pockets, fills the pockets with product and severs the filled pockets to form individual packages in conventional fashion.

It should be apparent to persons skilled in the art that, instead of being mounted to the end of a pivotable arm, the dancer roller 36 could be mounted to the end of an arm that is displaced linearly by an air cylinder or similar device.

In accordance with the embodiment depicted in FIG. 1, the tape and web are advancing continuously through the drag sealer 40 at a constant speed, whereby incremental portions of the slider-carrying fastener tape are joined to respective incremental portions of the web. This process of joining the fastener tape to the web of bag making material occurs continuously during each of a succession of work cycles. Each work cycle, however, is distinguished by two phases: a dwell time during which the clamp 32 is closed and the portion of the fastener tape upstream of the clamp is not advancing; and an intermittent advancement phase during which the clamp 32 is open. When the clamp 32 is open, the grip-and-pull mechanism (item 34 in FIG. 1) advances the gripped portion of the fastener tape at a speed greater than the speed at which the joined tape and web are moving through the drag sealer 40. During each intermittent advancement, the free-floating dancer roller 36 displaces downwardly, taking up slack in and accumulating fastener tape as it arrives at a rate faster than the rate at which tape leaves accumulator 35. Later, when the fastener tape 2 is clamped by the clamp 32, the continuously advancing joined tape and web pull the accumulated portion of the fastener tape toward the drag sealer 40 as the free-floating dancer roller 36 displaces upwardly. This work cycle is repeated during machine operation.

Figure 2:
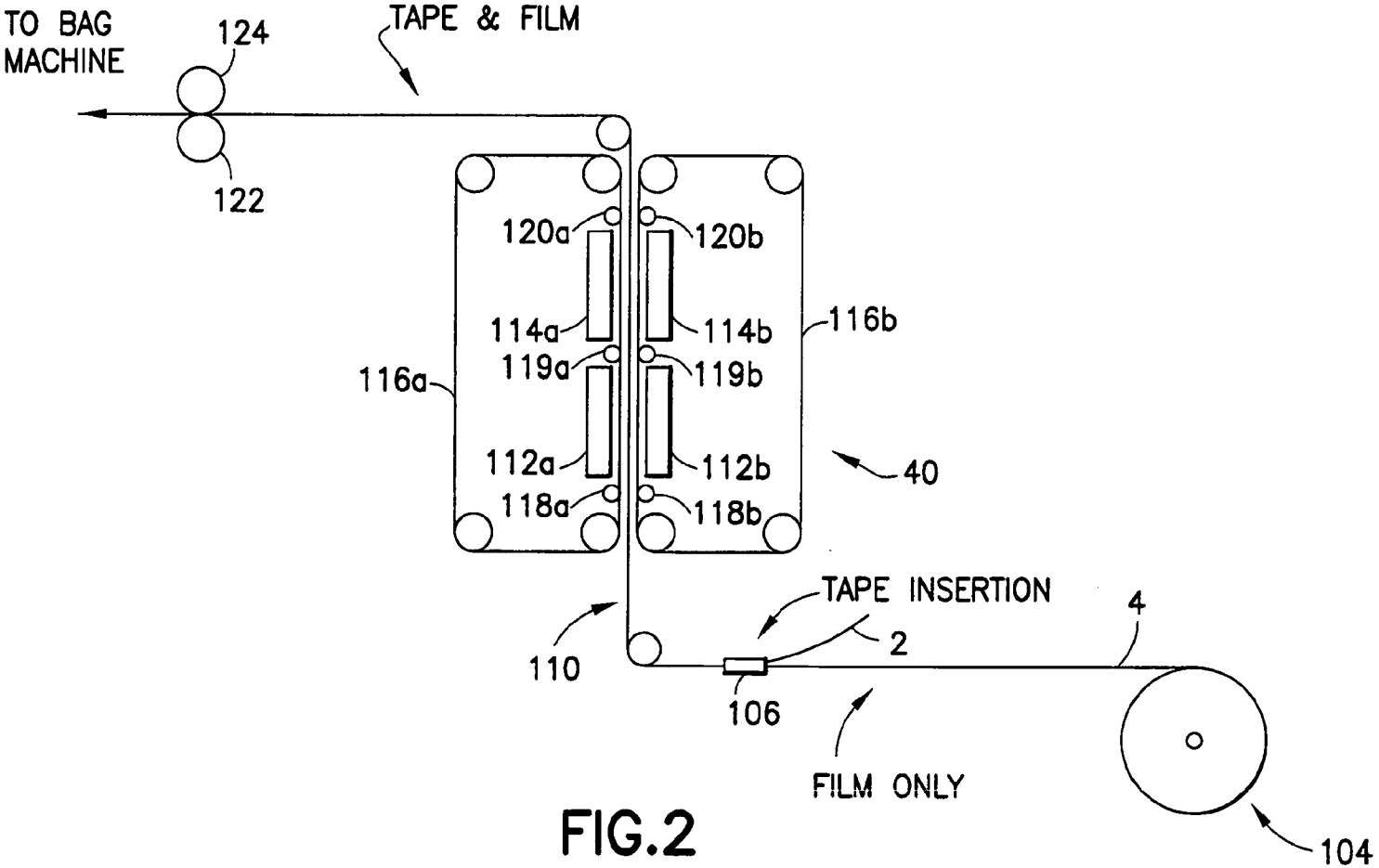
FIG. 2 is a drawing showing the structure of a conventional drag sealer of a type that can be employed in the automated equipment depicted in FIG. 1.
Figure 3:
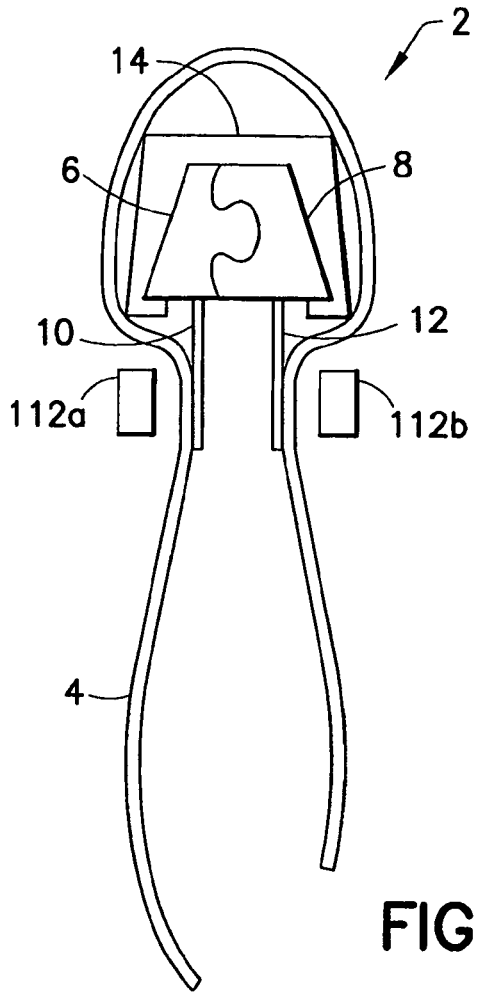
FIG. 3 is a drawing showing a sectional view of a folded web and a flanged zipper tape being passed through a drag sealer.

FIG. 2 shows a drag sealer that works in conjunction with a bag making machine. A pre-folded web 4 of bag making film is paid out from a supply roll 104 with the fold on top and a fastener tape 2 is inserted in the fold of the web (as shown in FIG. 3) by a tape inserter 106. The fastener tape and folded web are then threaded through the drag sealer 40 and a pair of motor-driven pinch rolls 122 and 124. Typically the pinch rolls 122 and 124, which pull the web 4 through the drag sealer 40, are part of the bag making machine. As an alternative to paying out a pre-folded web 4 of bag making film, film that is not folded can be wound on supply roll 104. In this case, a conventional folding board or plow (not shown in FIG. 2) would be installed between the web supply roll 104 and the tape inserter 106.

After passing through the accumulator (shown in FIG. 1), the fastener tape is guided into position inside the inverted folded web by the tape inserter 106, which comprises a channel having a cross-sectional profile shaped to maintain the orientation of the slider-carrying fastener tape 2 as it is fed toward the folded web 4. Sets of opposing guide rollers may be provided at any points downstream of the tape inserter to maintain the position of the inserted fastener tape 2 in parallel with and sandwiched between the opposing walls of the folded web 104.

The folded web 4 and the fastener tape 2 are then advanced together through the drag sealer 40 with the inverted web in generally vertical position. In the disclosed embodiment, the drag sealer 40 is a sealing apparatus comprising a first pair of mutually opposing heated sealing bars 112*a* and 112*b* and a second pair of mutually opposing heated sealing bars 114*a* and 114*b*. The sealing bars 112*a* and 112*b* are displaceable away from each other, as are the sealing bars 114*a* and 114*b*. Sealing of the fastener tape to the folded web of bag making film occurs while the sealing bars are in their respective extended (toward each other) positions. The sealing bars are retracted (away from each other) as needed, e.g., during threading of the web and tape through the sealing apparatus prior to startup.

As the folded web 4 with inserted fastener tape 2 advance continuously between the opposing sets of sealing bars, the fastener tape is sealed to opposing portions of the folded web of the bag making film, thereby continuously attaching incoming sections of the moving fastener tape to adjoining sections of the moving web. FIG. 3 shows the positional relationships in the drag sealer for the case wherein the web has been folded so that the sides are unequal in length and wherein the fastener tape 2 is of a type comprising a pair of extruded plastic zipper strips having respective mutually interlockable profiled closure members 6 and 8 and respective zipper flanges 10 and 12 having one end respectively connected to the profiled closure members 6 and 8. More specifically, the fastener tape 2 and the slider 4 may be of the types disclosed in U.S. Pat. No. 6,047,450. FIG. 3 depicts a state wherein the zipper flanges 10 and 12 have been joined to respective portions of the folded web 4 by one or more pairs of heated sealing bars, only one pair of sealing bars 112*a* and 112*b* being shown. The gaps between the web and the sealing bars in FIG. 3 reflect the space occupied by the circulating barrier strips 116*a* and 116*b* shown in FIG. 2. During sealing, the fastener tape/web assembly is continuously advanced in a direction perpendicular to the plane of the paper in FIG. 3.

Referring again to FIG. 2, the sealing by the drag sealer is accomplished by electrically heating the sealing bars, the heat being conducted through respective endless barrier strips 116*a* and 116*b* made of Teflon or similar material, which circulate on respective sets of rollers. Teflon barrier strip 116*a* passes between one side of the folded web and the sealing bars 112*a* and 114*a*, while Teflon barrier strip 116*b* passes between the other side of the folded web and the sealing bars 112*b* and 114*b*. In the gaps between the opposing sealing bars, the web and fastener tape are sandwiched between and held together by the Teflon barrier strips 116*a* and 116*b*, which move with the web and fastener tape and prevent the bag making film from sticking against the stationary heated sealing bars during conduction heat sealing. The Teflon barrier strips and intervening web and fastener tape pass through the nips of a series of guide rollers respectively positioned in advance of the sealing bars (guide rollers 118*a* and 118*b*); in between the sealing bars (guide rollers 119*a* and 119*b*); and after the sealing bars (guide rollers 120*a* and 120*b*). It should be appreciated that for the sake of illustration, the Teflon barrier strips, the folded web and the sealing bars are shown in FIG. 2 with respective gaps between adjoining components, whereas in reality these components are in contact with each other when the sealing bars are in their extended positions. Likewise the nips formed by the opposing pairs of guide rollers have been shown in the drawing with gaps, when in actuality the Teflon barrier strips and the web with inserted fastener tape are pressed together in the nips and no gaps occur. The Teflon barrier strips 116*a* and 116*b* and the guide rollers 118*a*, 118*b*, 119*a*, 119*b*, 120*a* and 120*b* are disposed in the area of the fastener tape and do not extend the full height (i.e., the dimension transverse to the fastener tape) of the folded bag making film.

Although the implementation shown in FIG. 2 has two pairs of sealing bars arranged in series on each side of the traveling web and fastener tape, any number of sets of sealing bars can be used provided that sufficient heat is conducted into the fastener tape to cause the zipper flanges to seal to the bag making film.

Typically each sealing bar assembly (not shown in FIG. 2) comprises a seal bar core, a seal bar cap having a sealing bar projecting therefrom, an insulator, and another seal bar cap separated from the seal bar core by the insulator. The seal bar cap is fastened to the ends of threaded rods. The seal bar core has a pair of longitudinal channels that respectively house a thermocouple and an electric heater, both of which are electrically connected to a programmable heat controller by electrical wiring (neither of which are shown in FIG. 2). The thermocouple produces electrical signals representing the temperature of the seal bar core, which signals are received by the heat controller. The heat controller controls the level of electrical current supplied to the heater in accordance with a heat control program that is designed to maintain the sealing bar temperature within limits preset by the system operator. In particular, the temperature of the sealing bar must be selected such that the amount of heat conducted through the bag making film and into the adjoining zipper flange, during the time that the zipper flanges and film are pressed between the extended sealing bars, will achieve the desired result, namely, sealing of the zipper flange to the bag making film without "seal-through" of the zipper flanges, i.e., sealing of the zipper flanges to each other. The zipper flanges may be laminated with high-melting-point thermoplastic material on their confronting sides to prevent "seal-through" of the zipper flanges.

Figure 4:
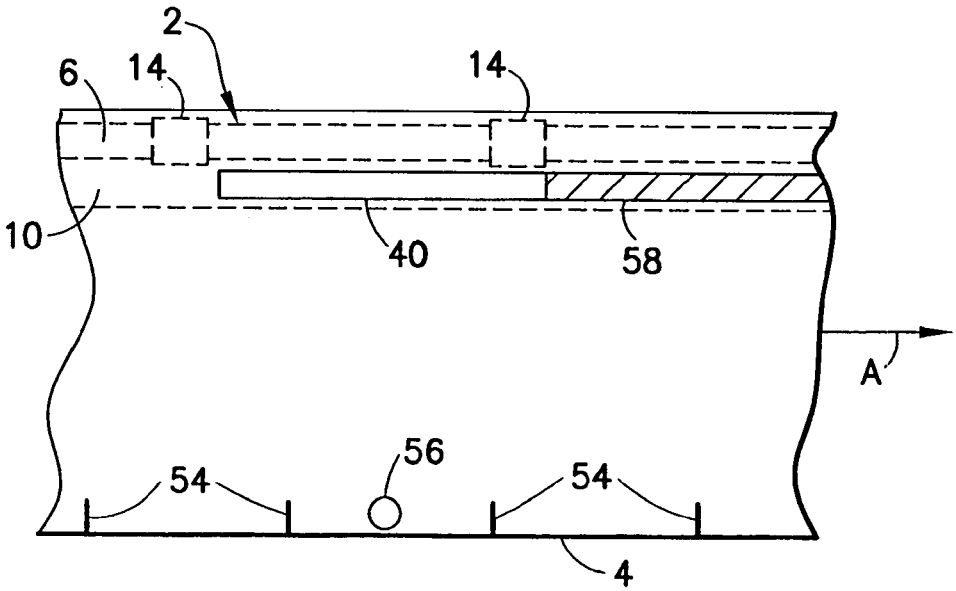
FIG. 4 is a drawing showing a photodetector installed at a drag sealing station in accordance with the embodiment depicted in FIG. 1.

The fastener tape and folded web that enter the drag sealing station unjoined, exit the drag sealing station joined together by permanent seals, one of which is represented by the band-shaped zone of hatching 58 shown in FIG. 4. The arrow A in FIG. 4 indicates the continuous advancement of the tape/web assembly as the pinch rolls 122 and 124 (see FIG. 2) continue to pull the joined fastener tape and web forward.

After the fastener tape has been sealed to the folded web having unequal sides, the assembly is advanced to a filling station, being reoriented during its travel so that the sides of the web are horizontal. After the product is placed between the sides of the folded web, the long side is wrapped around and fin sealed to the short side to seal and then the assembly is cross sealed and cut to form a completed filled bag.

All of the automated steps intermittently performed by the apparatus depicted in FIG. 1 may be coordinated and synchronized by a conventional programmable logic controller (PLC) that has been suitably programmed. Programmed control of the apparatus depicted in FIG. 1 is schematically represented in the block diagram of FIG. 6 for the case wherein the clamp and the grip-and-pull mechanism comprise gripper assemblies of the type described above. To ensure proper registration of the inserted sliders and the associated ultrasonically stomped slider end stop structures relative to the cross seals made on the folded web at a location downstream from the drag sealer, eye-marks 54 (see FIG. 4) are placed on a marginal portion of the web at bag width intervals in a lengthwise direction and a photodetector 56 is positioned in the vicinity of the drag sealer at a location where the passage of each eye-mark 54 can be photodetected as the tape/web assembly advances continuously.

The photodetector output is provided as feedback to the PLC, which actuates various components in response to a feedback signal representing the passage of each eye-mark 54 through the line-of-sight of the photodetector 56. The photodetector 56 is separated from the zone where cross sealing bars are applied to the bag web by a predetermined distance. In addition, during start-up (i.e., prior to machine operation) the bag web is threaded through the machine to a point where an eye-mark is in precise alignment with a fixed registration mark on the machine. In response to a photodetector output indicating the passage of an eye-mark, the PLC will actuate the ultrasonic welding assembly and the slider inserter. The result is that the sliders and the slider end stop structures will be placed in proper registration with the cross seals.

Figure 5:
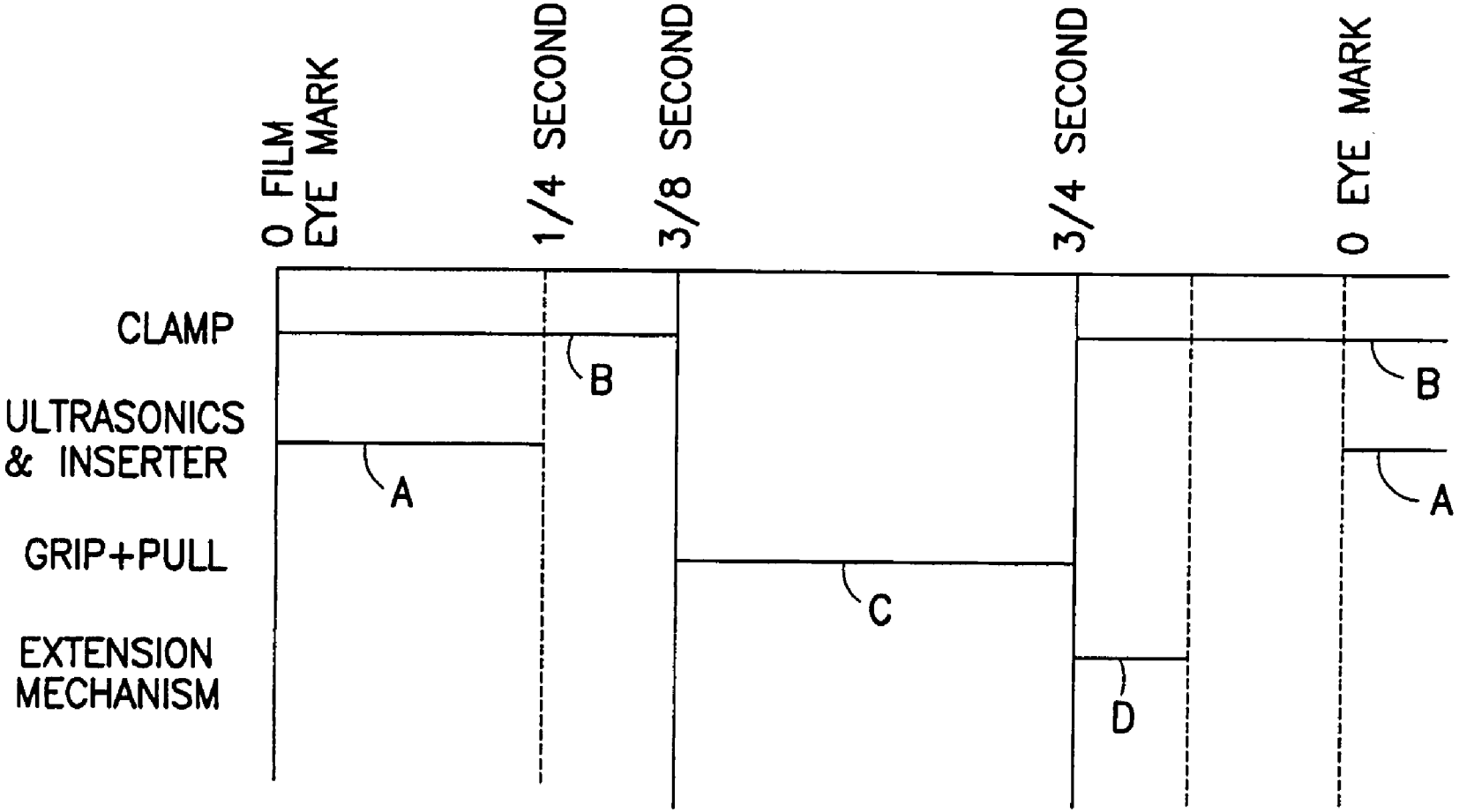
FIG. 5 is a timing diagram showing the operation of various components of the machine depicted in FIG. 1.

The timing diagram of FIG. 5 shows the operation of various components of the system depicted in FIG. 1 for each work cycle. For the purpose of illustration, it is assumed that the duration of each work cycle is 1 second. Each time that an eye-mark is detected by the photodetector, the ultrasonic welding assembly and slider inserter are actuated by the PLC. In the case of the ultrasonic welding assembly, such actuation may entail moving the horn and/or anvil and/or turning on the ultrasonic transducer. The interval of time during which the ultrasonic welding assembly and slider inserter operate is represented by line A in FIG. 5. Actuation of the ultrasonic welding assembly and slider inserter occurs while the portions of the fastener tape resident at those stations are stationary. This is accomplished by having previously caused the clamp to be closed, which is done at a predetermined interval of time subsequent to detection of passage of the preceding eye-mark (e.g. at ¾ second in the work cycle shown in FIG. 5). The interval of time during which the clamp grips the fastener tape is represented by line B in FIG. 5.

As shown in FIG. 5, while the fastener tape is still clamped, the ultrasonic welding assembly and slider inserter are inactivated (e.g., at ¼ second in the work cycle). After a short delay (e.g., at second in the work cycle shown in FIG. 5), the clamp is commanded to release the fastener tape and the grip-and-pull mechanism is commanded to grip the fastener tape. (The interval of time during which the grip-and-pull mechanism grips the fastener tape is represented by line C in FIG. 5). These commands are coordinated such that there is a brief interval of time during which the fastener tape is gripped by both devices. After the clamp has released the fastener tape, the grip-and-pull mechanism is commanded to pull the portion of the fastener tape that spans the ultrasonic welding and slider insertion stations in a forward direction by a distance equal to slightly less than one bag width. (This second command to the grip-and-pull mechanism is not represented in FIG. 5.) At the end of the stroke of the grip-and-pull mechanism, the clamp is again closed (e.g., at ¾ second in the work cycle shown in FIG. 5). The PLC then causes the grip-and-pull mechanism to release its grip and then return to its home position, which events (not indicated in FIG. 5) occur during the time interval during which the fastener tape is clamped.

Furthermore, the extension mechanism for stretching the fastener tape is actuated (for an instant) after the fastener tape has been clamped. The interval of time during which the accumulator is being extended, thereby stretching the fastener tape, is represented by line D in FIG. 5. The clamp and extension mechanism must be controlled such that the fastener tape is first clamped and thereafter the portion of the fastener tape disposed immediately downstream of the clamp is tensioned. The stretching operation depends on the fastener tape being gripped and held stationary immediately upstream of the accumulator, while the bag machine is pulling the portion of the fastener tape disposed downstream of the accumulator. The extension mechanism is turned off before the start of the next work cycle. When the extension mechanism is not activated, the dancer roller (item 36 in FIG. 1) is free to float up and down, the weight of the dancer roller taking up the slack in the fastener tape.

Figure 6:
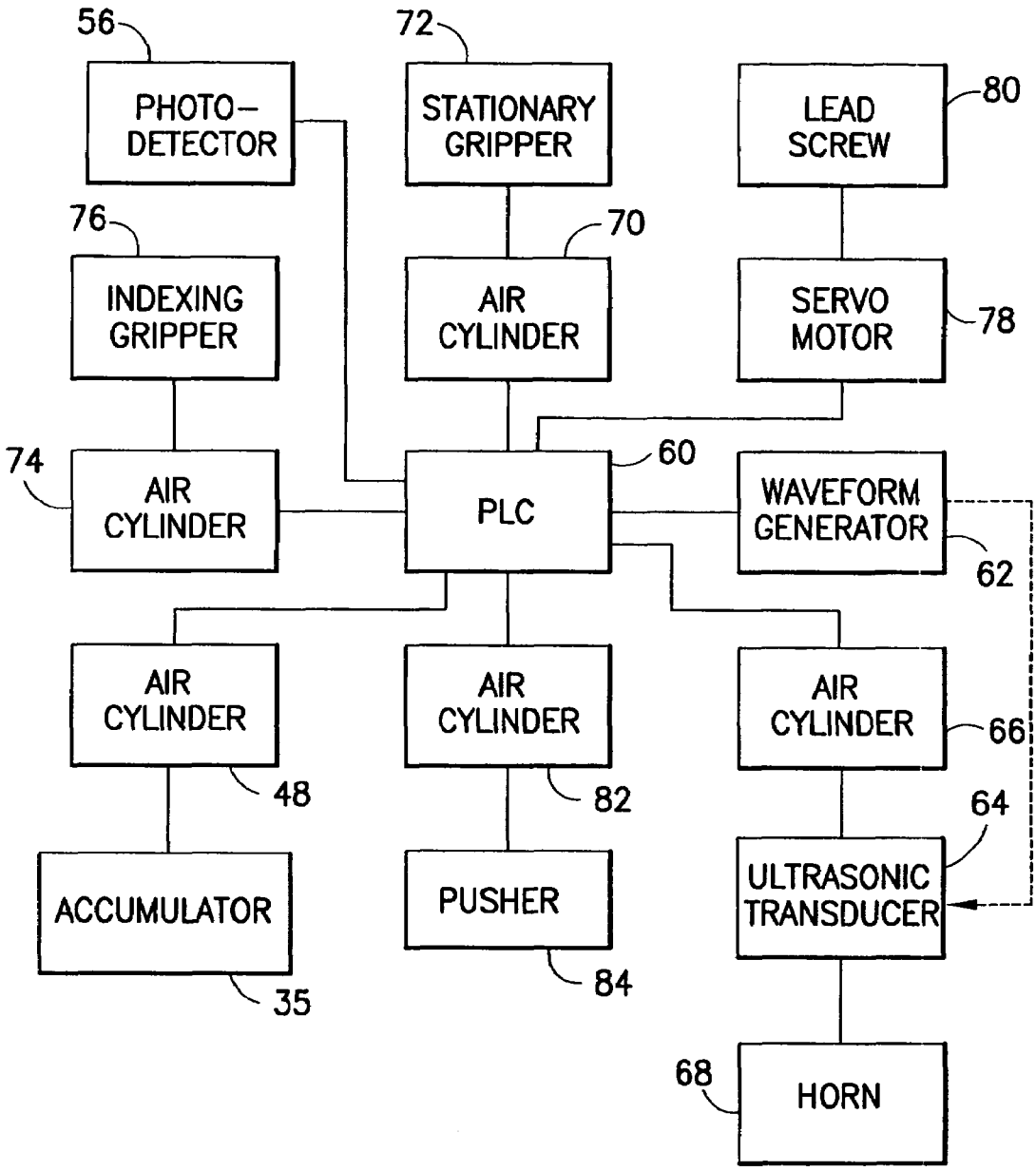
FIG. 6 is a block diagram representing a system for controlling the operation of various components of the machine depicted in FIG. 1.

Referring now to FIG. 6, in accordance with one implementation of the embodiment depicted in FIG. 1, the PLC 60 is programmed to control various solenoids that open various strategically placed valves that, when open, connect a source of compressed air to respective air cylinders 74, 70, 66, 82 and 48. The air cylinders 74, 70, 66, 82 and 48 in turn respectively actuate movement of an indexing gripper assembly 76 of the grip-and-pull mechanism, a stationary gripper assembly 72 of the clamp, a horn 68 of the ultrasonic welding assembly, a pusher 84 of the slider inserter and a dancer roller of the accumulator 35. In addition, the PLC 60 controls a servomotor 78 that drives rotation of a lead screw 80, which rotation is converted into linear displacement of the indexing gripper assembly by means of the type previously described. The PLC 60 also controls a waveform generator 62 that supplies an electrical waveform to an ultrasonic transducer 64, which transducer in turn outputs acoustic waves (represented by the dashed line in FIG. 6) that are delivered to the fastener tape by the horn 68.

As previously discussed in detail, the PLC 60 receives feedback from the photodetector 56 and controls the various devices shown in FIG. 6 in accordance with a work cycle that has a duration equal to the time interval between successive feedback signals representing photodetection of successive eye-marks. While the stationary gripper assembly 72 is open and the indexing gripper assembly 76 is closed the PLC 60 sends control signals to the servomotor 78 that cause the lead screw 80 to rotate in a direction that extends the indexing gripper assembly 76 from a home position to an away position. Conversely, while the stationary gripper assembly 72 is closed and the indexing gripper assembly 76 is open, the PLC 60 sends control signals to the servomotor 78 that cause the lead screw 80 to rotate in a direction that retracts the indexing gripper assembly 76 from an away position to a home position. In addition, while the stationary gripper assembly 72 is closed and the indexing gripper assembly 76 is open, the PLC 60 causes the air cylinder 66 to extend the activated ultrasonic horn 68 until it contacts the fastener tape and also causes the air cylinder 82 to extend the pusher 84 so that a slider is pushed onto the fastener tape. The horn is extended for a period of time long enough to allow the ultrasonic stomping operation to be completed. The PLC may also be programmed to control a motor (not shown in FIG. 6) that drives the fastener tape supply reel (item 20 in FIG. 1) to rotate, thereby paying out fastener tape, as a function of feedback signals from a sensor that monitors the vertical position of the dancer roller (item 24 in FIG. 1).

Hydraulic cylinders can be employed as actuators in place of air, i.e., pneumatic, cylinders. A person skilled in the art of machinery design will readily appreciate that displacing means other than a cylinder can be used to displace components such as the horn of the ultrasonic welding assembly and the pusher of the slider inserter. For the sake of illustration, such mechanical displacement devices include rack and pinion arrangements or lead screw/coupling nut assemblies, rotation of the pinion or lead screw being driven by an electric motor.

Figure 7:
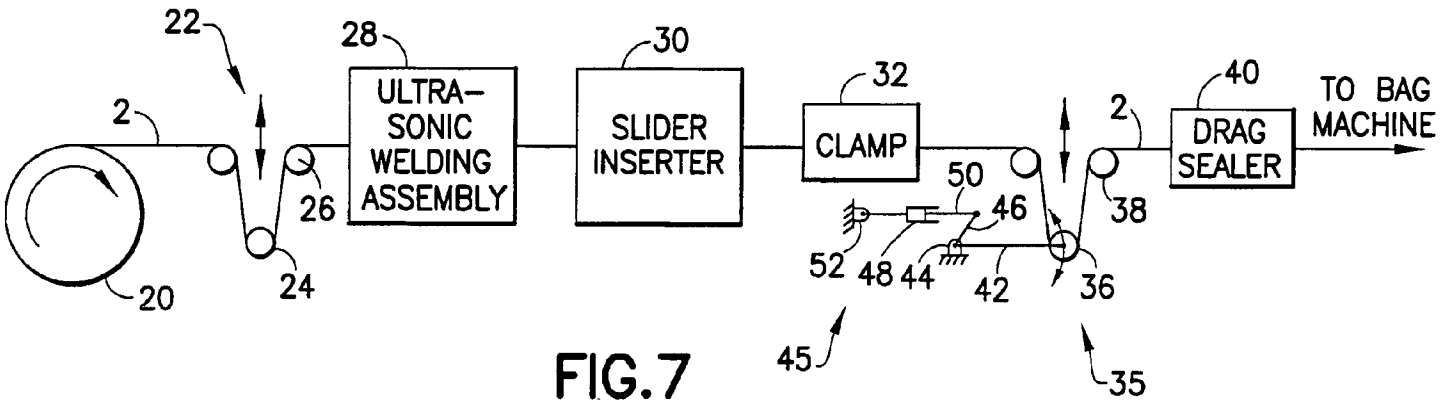
FIG. 7 is a block diagram representing automated equipment for inserting sliders and forming slider end stop structures on a fastener tape and then joining the fastener tape to bag making material in accordance with another embodiment of the invention.

A method of registering intermittently moved fastener tape with continuously moving bag making material in accordance with another embodiment of the invention is shown in FIG. 7. Components in FIG. 7 that bear the same reference numerals as those used in FIG. 1 may have the same structure as described above, although the operation of certain components, as will be explained in detail below) may differ due to the PLC being programmed differently. The major differences are that the embodiment has no grip-and-pull mechanism, the upstream portion of the fastener tape 2 is advanced intermittently by repeated actuation of the extension mechanism 45, which in turn causes the accumulator 35 to extend. Although a rotary accumulator is shown in FIG. 7, a linear accumulator could be used.

In accordance with the embodiment depicted in FIG. 7, a fastener tape 2 and a web of bag making material (not shown) are advancing continuously through the drag sealer 40 at a constant speed, whereby incremental portions of the slider-carrying fastener tape are joined to respective incremental portions of the web. This process of joining the fastener tape to the web of bag making material occurs continuously during each of a succession of work cycles. Each work cycle, however, is distinguished by two phases: a dwell time during which the clamp 32 is closed and the portion of the fastener tape 2 upstream of the clamp is not advancing; and an intermittent advancement phase during which the clamp 32 is open. When the clamp 32 is open, the accumulator 35 is extended (i.e., the dancer roller 36 displaces downwardly) by the extension mechanism 45 at a rate such that the upstream portion of the fastener tape is advanced at a speed greater than the speed at which the joined tape and web are moving through the drag sealer 40. During extension, the accumulator 35 accumulates fastener tape as it arrives at a rate faster than the rate at which tape leaves. Later, when the fastener tape 2 is clamped by the clamp 32, the extension mechanism is inactivated and the continuously advancing joined tape and web pull the accumulated portion of the fastener tape toward the drag sealer 40 as the accumulator retracts (i.e., as the now free-floating dancer roller 36 displaces upwardly). This work cycle is repeated during machine operation.

All of the automated steps intermittently performed by the apparatus depicted in FIG. 7 may be coordinated and synchronized by a PLC that has been suitably programmed. To ensure proper registration of the inserted sliders and the associated ultrasonically stomped slider end stop structures relative to the cross seals made on the folded web at a location downstream from the drag sealer, eye-marks are again placed on the web at bag width intervals in a lengthwise direction and a photodetector (not shown in FIG. 7) is positioned in the vicinity of the drag sealer at a location where the passage of each eye-mark can be photodetected as the tape/web assembly advances continuously. The photodetector output is provided as feedback to the PLC, which actuates the clamp, the ultrasonic welding assembly, the slider inserter and the accumulator in accordance with the timing of a feedback signal representing the passage of each eye-mark through the line-of-sight of the photodetector. The result is that the sliders and the slider end stop structures will be placed on the fastener tape in proper registration with the cross seals formed later on the tape/web assembly.

Figure 8:
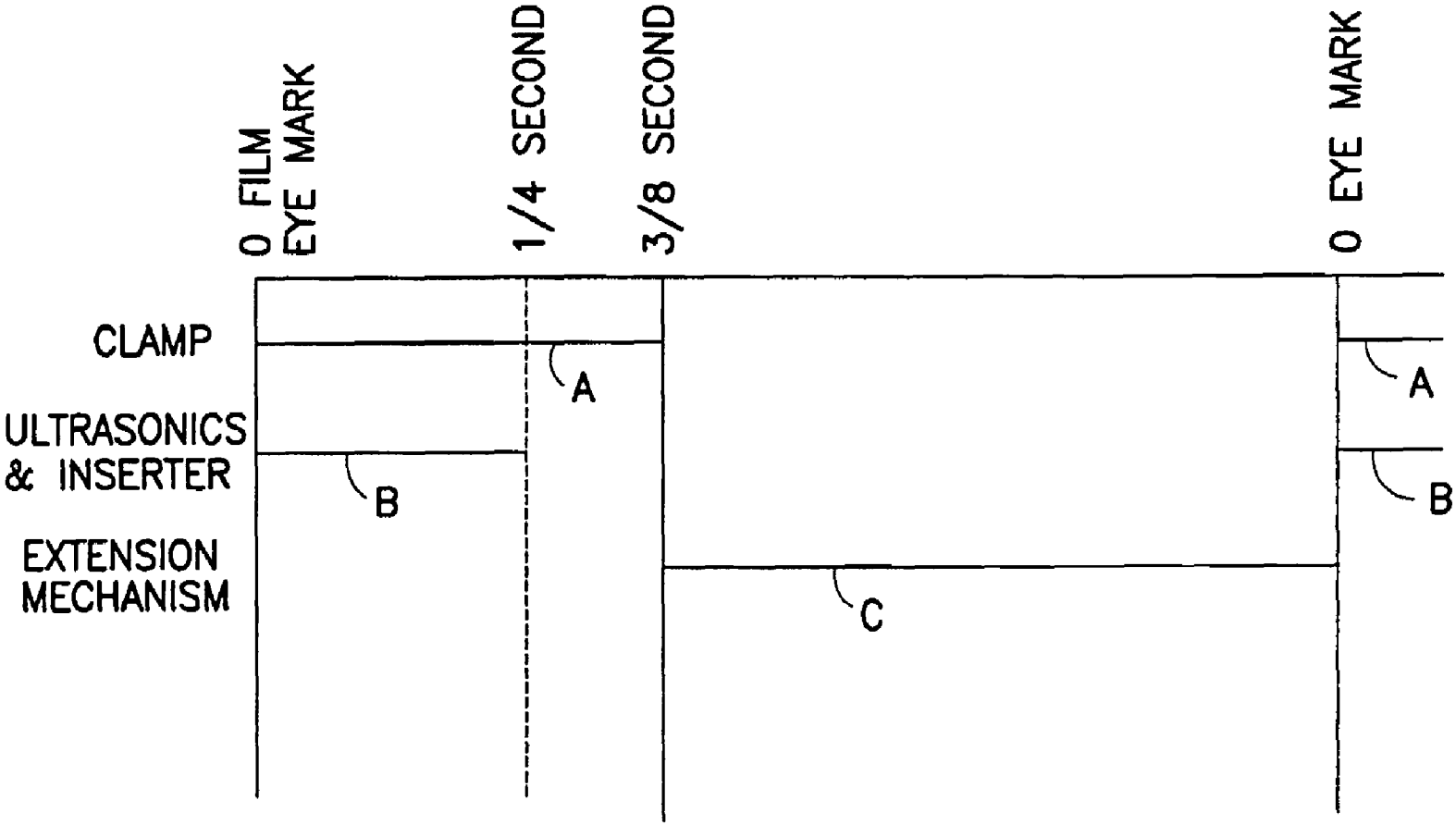
FIG. 8 is a timing diagram showing the operation of various components of the machine depicted in FIG. 7.

The timing diagram of FIG. 8 shows the operation of various components of the system depicted in FIG. 7 during each work cycle. For the purpose of illustration, it is again assumed that the duration of each work cycle is 1 second. Each time that an eye-mark is detected by the photodetector, the clamp, the ultrasonic welding assembly and the slider inserter are actuated by the PLC. The interval of time during which the clamp is closed is represented by line A in FIG. 8. The interval of time during which the ultrasonic welding assembly and slider inserter operate is represented by line B in FIG. 8. Actuation of the ultrasonic welding assembly and slider inserter occurs while the portions of the fastener tape resident at those stations are stationary. As shown in FIG. 8, while the fastener tape is still clamped, the ultrasonic welding assembly and slider inserter are inactivated (e.g., at ¼ second in the work cycle). After a short delay (e.g., at second in the work cycle shown in FIG. 8), the clamp is commanded to release the fastener tape and the extension mechanism is commanded to actuate the extension of the accumulator. The interval of time during which the accumulator is being extended is represented by line C in FIG. 8. During accumulation with the clamp open, the portion of the fastener tape upstream of the accumulator is advancing at a speed greater than the speed with which the portion of the fastener tape downstream of the accumulator is advancing. When the next eye-mark is photodetected, the clamp is again closed and the process repeats itself.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "controller" means an electronic computer, central processing unit (CPU), microchip, microcontroller or other programmable device or a system of interconnected and synchronized control units, each control unit comprising an electronic computer, CPU, microchip, microcontroller or other programmable device. As used in the claims, the terms "upstream portion" and "downstream portion" refer to the relative positions of respective portions of a fastener tape in a fixed frame of reference, e.g., the upstream and downstream portions during a particular work cycle are respectively upstream and downstream of the accumulator. During the fastener processing stream, each upstream portion of the fastener tape during one work cycle will ultimately become a downstream portion in a later work cycle. Furthermore, in the absence of explicit language setting forth the order in which certain steps should be performed, the method claims should not be construed to require that steps be performed in the order in which they are recited.

The invention claimed is:

1. A method of manufacture comprising the following steps:

(a) continuously advancing a web of bag making material at a first rate;

(b) continuously joining portions of a downstream portion of a fastener tape to respective portions of said continuously advancing web of bag making material;

(c) intermittently advancing an upstream portion of said fastener tape while said downstream portion is advancing continuously, the halt at the end of each intermittent advance being the start of the next work cycle, said upstream portion of said fastener tape being stationary during a respective dwell time of each work cycle and advancing during the remainder of each work cycle at a second rate faster than said first rate;

(d) accumulating a portion of said fastener tape disposed between said upstream and downstream portions to compensate for the difference in said first and second rates during said remainder of each work cycle; and (e) inserting a respective slider onto said upstream portion of said fastener tape during each dwell time.

2. The method as recited in claim 1, further comprising the step of forming a slider end stop structure on said upstream portion of said fastener tape during each dwell time.

3. The method as recited in claim 1, further comprising the step of clamping said upstream portion of said fastener tape during each dwell time at a first fixed station downstream from a second fixed station where said slider inserting step is performed and upstream from a third fixed station where said accumulating step is performed, wherein step (b) is performed at a fourth fixed station downstream from said third fixed station.

4. The method as recited in claim 3, further comprising the step of stretching the portion of said fastener tape that spans said third and fourth fixed stations at the start of each dwell time.

5. The method as recited in claim 4, wherein said stretching step comprises the step of driving an effector to move from a retracted position to an extended position in a direction generally orthogonal to a horizontal line, said effector being in contact with said fastener tape during said movement.

6. The method as recited in claim 3, wherein step (c) comprises the steps of gripping and then pulling said upstream portion of said fastener tape forward, and later releasing the grip on said upstream portion of said fastener tape after the latter has been clamped.

7. The method as recited in claim 3, wherein step (c) comprises the step of driving an effector to move from a retracted position to an extended position in a direction generally orthogonal to a horizontal line, said effector being in contact with said fastener tape during said movement.

8. The method as recited in claim 3, further comprising the following steps:

placing a succession of markings spaced at regular intervals along the length of said web of bag making material; and photodetecting the passage of said markings at a fixed location, wherein a respective slider is inserted in response to each photodetection of a respective marking.

9. A method of manufacture comprising the following steps:

(a) continuously advancing a web of bag making material along a first process pathway that passes through a joining station;

(b) advancing a fastener tape comprising mutually interlocked first and second fastener strips made of flexible material along a second process pathway that passes through said joining station, said second process pathway comprising a first portion disposed upstream of and a second portion disposed at and downstream from said joining station, the portion of said fastener tape resident in said first portion of said second process pathway being advanced intermittently and the portion of said fastener tape resident in said second portion of said second process pathway being advanced continuously;

(c) continuously joining together the respective portions of said fastener tape and said web of bag making material continuously advancing through said joining station; and (d) during successive dwell times between successive intermittent advances, inserting respective sliders onto said fastener tape, said sliders being inserted at a first fixed location along said first portion of said second process pathway, the result being a succession of sliders spaced at intervals along the length of the portion of said fastener tape disposed downstream of said first fixed location.

10. The method as recited in claim 9, further comprising the following steps:

folding incremental portions of said web of bag making material to form a first folded side and a second folded side interconnected by a folded section; and guiding incremental portions of the continuously advancing portion of said fastener tape to a position between said first and second folded sides of said incremental portions of said web of bag making material, wherein incremental portions of said first and second fastener strips are respectively joined to incremental portions of said first and second folded sides of said web of bag making material as said respective incremental portions pass through said joining station.

11. The method as recited in claim 9, further comprising the following steps performed during said successive dwell times between successive intermittent advances of the portion of said fastener tape resident in said first portion of said second process pathway:

joining respective portions of said first and second fastener strips to each other, a respective one of said fastener joints being formed during each dwell time at a second fixed location along said first portion of said second process pathway, the result being a succession of fastener joints spaced at regular intervals with openable fastener sections therebetween along the portion of said fastener tape disposed downstream of said second fixed location.

12. The method as recited in claim 11, wherein said fastener joints are formed by ultrasonic welding.

13. The method as recited in claim 9, further comprising the steps of clamping a respective portion of said fastener tape during each dwell time and then unclamping said respective portion at the end of each dwell time, said clamping and unclamping being performed at a third fixed location along said first portion of said second process pathway, said third fixed location being between said first fixed location and said joining station.

14. The method as recited in claim 13, further comprising the following steps:

placing a succession of markings spaced at regular intervals along the length of said of said web of bag making material; and photodetecting the passage of said markings at a fourth fixed location disposed along said second process pathway, wherein a respective slider is inserted in response to each photodetection of a respective marking.

15. The method as recited in claim 13, further comprising the steps of accumulating respective portions of said fastener tape during each dwell time in an accumulation zone located between said third fixed location and said joining station.

16. The method as recited in claim 15, further comprising the steps of stretching a respective portion of said fastener tape during each dwell time, the fastener tape portion being stretched while disposed along a third portion of said first process pathway, said third portion being between said first and second portions of said first process pathway.

* * * * *